United States Patent [19]

Huckaby

[11] 4,224,993

[45] Sep. 30, 1980

[54] DEWAXING VALVE FOR USE IN OIL WELLS

[76] Inventor: Leonard Huckaby, P.O. Box 152, Wayne, Okla. 73095

[21] Appl. No.: 75,094

[22] Filed: Sep. 13, 1979

[51] Int. Cl.[3] ..... E21B 34/10; E21B 37/06

[52] U.S. Cl. ..... 166/325; 166/304; 137/509

[58] Field of Search ..... 166/325, 304, 314, 319; 137/509

[56] References Cited

U.S. PATENT DOCUMENTS

| | | | |
|---|---|---|---|
| 3,085,629 | 4/1963 | Henderson | 166/325 |
| 3,102,590 | 9/1963 | Grounds | 166/325 X |
| 3,236,256 | 2/1966 | Valentine | 137/509 |
| 3,361,205 | 1/1968 | Waldron | 166/325 X |
| 3,580,333 | 5/1971 | Douglas | 166/325 |
| 3,583,440 | 6/1971 | Anderson | 137/509 X |
| 4,049,057 | 9/1977 | Hewes | 166/325 X |
| 4,059,157 | 11/1977 | Crowe | 166/325 X |
| 4,063,594 | 12/1977 | Canterbury | 166/325 |

*Primary Examiner*—Stephen J. Novosad
*Attorney, Agent, or Firm*—Ralph B. Pastoriza

[57] ABSTRACT

The dewaxing valve comprises a ball and valve seat where the ball is on the upstream side of the flow of hot dewaxing fluid through a production pipe string to the well annulus. The design of the dewaxing valve is such that it can be readily attached to a production tube in the production tubing string by simply boring a hole in the side of the production tube and welding a supporting T-collar for the valve to the periphery of the side opening.

7 Claims, 2 Drawing Figures

DEWAXING VALVE FOR USE IN OIL WELLS

This invention relates generally to oil well operations and more particularly to an improved dewaxing valve for use in oil wells.

BACKGROUND OF THE INVENTION

In oil producing wells, a production tubing string extends centrally through the well casing to the lower depths of the well where oil is present. Sucker rods pass through the pipe string to an appropriate down hole pump so that oil is then brought up through the production tubing string to the surface of the well.

The temperature in the lower portions of the well is sufficiently high that wax, such as parafin, will not solidify out of the petroleum products being pumped to the surface. However, such solidification can and often does occur when cooler regions of the well are reached. The solidification of the wax results in a build up of wax on the interior of the production string at these higher cooler levels and impedes the proper flow of oil.

In view of the foregoing, it is common practice to circulate down the production tubing a hot fluid such as very hot oil which serves to melt any built up wax or parafin. In this respect, there is provided a special valve sub in the lower portion of the production tubing string to pass the hot dewaxing oil from the interior of the tubing to the well annulus; that is, to the exterior of the remaining portion of the tubing through which it is not necessary to pass the hot dewaxing fluid.

The particular valves presently used are hydraulically operated; that is, they usually comprise a valve seat and spring biased ball wherein the ball is located on the downstream side of the valve seat; that is, the side of the valve seat communicating with the well annulus. When a sufficient hydraulic pressure of the hot dewaxing fluid is built up, it will simply force the ball off of the valve seat against the bias of the spring so that the dewaxing fluid can escape to the annulus.

Typical prior art dewaxing valves of the foregoing type are shown, by way of example, in U.S. Pat. Nos. 2,300,348; 3,014,531; and 4,011,906.

Basically, two problems arise with valves of the above type. First, should the biasing spring for the ball fail, the ball will drop away from the valve seat and all of the oil within the production tubing will be lost into the annulus. Second, since the ball is unseated from the valve seat by hydraulic pressure of the dewaxing fluid against the bias of the springs, a relatively high pressure is required to initially unseat the ball. Thereafter, when flow occurs around the ball past the seat, there is a drop in pressure on the ball and the spring can reseat the ball, setting up a "chattering" situation. Of course, the very high pressure can be maintained even under flowing conditions but the result is fairly unsatisfactory, erratic flow still occurring and the flow rate being so fast that proper dewaxing cannot always be realized.

BRIEF DESCRIPTION OF THE PRESENT INVENTION

With the foregoing considerations in mind, the present invention contemplates an improved dewaxing valve for use in oil wells overcoming the above mentioned two basic problems with prior art structures.

More particularly, in accord with the present invention, contrary to prior art structures, the dewaxing valve comprises a ball and seat arrangement wherein the ball is positioned on the upstream side of the valve seat rather than the downstream side. Cooperating with this arrangement are appropriate means in the valve responsive to a fluid pressure in the production tube to which the valve seat is secured exceeding a predetermined value to lift the ball from the seat. Once the ball is lifted from the seat, the theretofore existing higher hydraulic pressure tending to hold the ball on the valve seat is lowered so that the ball "snaps" open in a toggle-like manner to a fully open condition to permit uniform and proper flow of the hot dewaxing fluid through the valve structure to the well annulus.

By providing the ball on the upstream side of the valve seat as described above, a secondary advantage results in that should the means responsive to hydraulic fluid for unseating the ball fail in any manner, the ball will remain closed on top of the seat so that a failsafe condition results.

BRIEF DESCRIPTION OF THE DRAWINGS

A better understanding of this invention as well as many further features and advantages thereof will be had by now referring to a preferred embodiment thereof as illustrated in the accompanying drawings in which.

DETAILED DESCRIPTION OF THE PREFERRED EMBODIMENT

Figure 1:
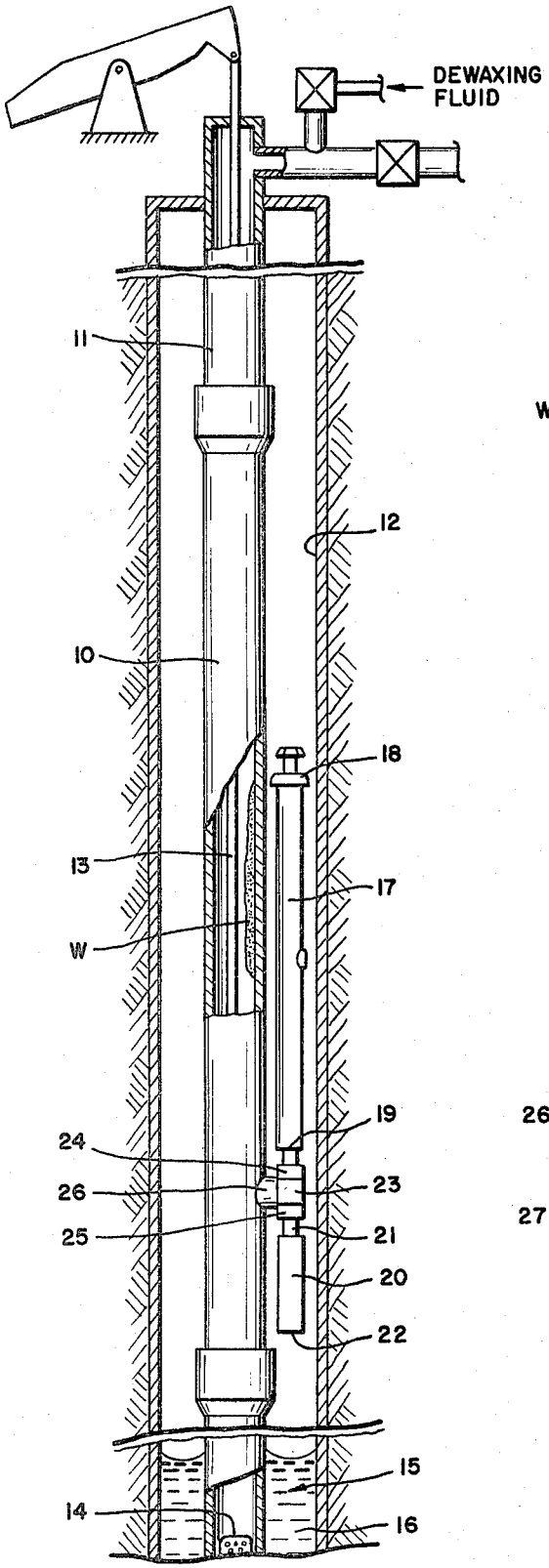
FIG. 1 is a fragmentary cross section with certain portions shown in full lines and other portions broken away of an oil well bore hole incorporating the dewaxing valve of this invention.

Referring first to FIG. 1, there is shown a production tube 10 constituting part of a production tubing string 11 within an oil well casing 12. As shown in the broken away central portion of the drawing, there is incorporated within the tubing sucker rods one of which is shown at 13 extending through the production tubing string to operate a down hole pump, the upper portion of which is indicated at 14 in the bottom of FIG. 1. Pump 14 communicates with the well annulus indicated by the arrow 15 defined between the interior of the casing 12 and the lower exterior portion of the tubing string to pump oil 16 in this lower portion of the annulus up through the production tubing to the surface of the well.

As mentioned earlier herein, during normal production operations, wax or similar parafin-like products in the oil being pumped upwardly tends to solidify in the upper portions of the production string because of the cool environment as compared to the deeper areas of the well. Thus, wax can build up on the interior of the production tubing such, as indicated by way of example, at W in the broken away portion of FIG. 1. As also mentioned heretofore, the normal procedure for removing such wax or parafin material is to pump downwardly through the pipe string a hot liquid such as hot oil to melt the built-up wax and carry it with the hot oil down through the tubing and out an appropriate valve to the well annulus. In this respect, it is not necessary to pump hot fluid down the entire pipe string, but only through the upper pipe string sections subject to having wax solidified thereon, the lower pipe string portions being in a sufficiently high temperature environment so that wax will not form. The valve for diverting the dewaxing fluid from the interior of the pipe string to the well annulus is thus normally located slightly below the point where the temperature changes sufficiently to cause solidification of wax.

Most prior art types of dewaxing valves constituted complete sub-sections which would be substituted for one of the production tubes in the tubing string or simply inserted between a connection point of two series connected tubes. The dewaxing valve in accord with the present invention, however, is designed to simply be secured to a side opening formed in an already existing production tube.

More particularly, and still referring to FIG. 1, the dewaxing valve of the present invention comprises a spring barrel 17 having upper and lower ends 18 and 19 and of a diameter to fit within the well annulus 15 in adjacent parallel relationship to the production tubing such as the production tube 10 as shown.

A valve seat housing 20, in turn, has upper and lower ends 21 and 22 positioned in axial alignment with the spring barrel 17. A T-collar 23 having upper and lower arms 24 and 25 for connection in coaxial alignment to the lower end of the spring barrel 17 and upper end of the valve seat housing, respectively, further includes a laterally extending stem 26. This stem has a lateral opening for connection with the interior of the spring barrel 17 and valve seat housing 20.

Figure 2:
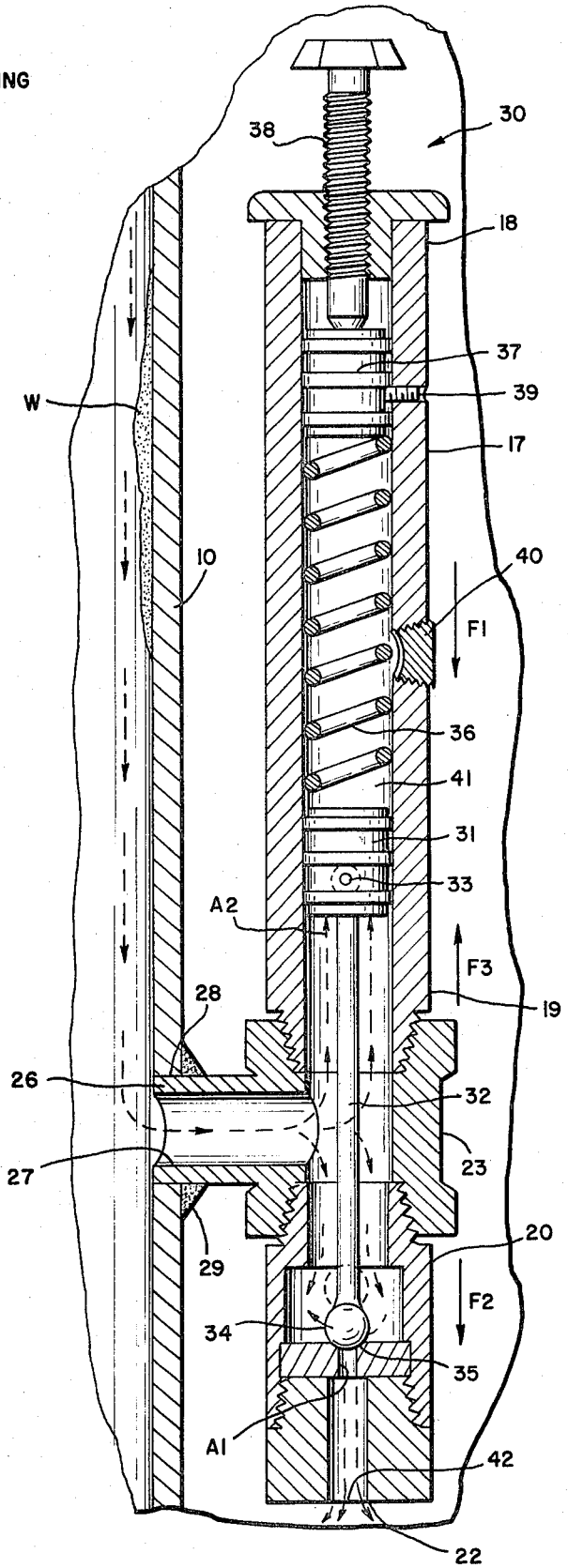
FIG. 2 is a greatly enlarged fragmentary cross section of the valve portion of the structure shown in FIG. 1.

Referring now to the enlarged sectional view of FIG. 2, the referred to lateral opening for the valve stem 26 is shown at 27. The valve stem itself is welded to the periphery of an appropriate hole 28 formed in the side of the production tube 10. This welding is indicated at 29. With this arrangement, the lateral opening 27 of the stem is in communication with the interior of the production tube 10.

Referring now to further details of the valve structure, particularly the upper end thereof, there is provided a stop means designated generally by the arrow 30. A piston in a lower portion of the spring barrel shown at 31 has a piston rod 32 connected to the piston head at 33 and extending therefrom into the valve seat housing 23. The lower end of the piston rod 32 terminates in a ball 34 rigidly secured thereto. A valve seat 35 within the valve seat housing 20 faces upwardly to receive and seat the ball to close off communication between the lateral opening 27 and the lower end of the housing in communication with the well annulus. Because the O-rings about the piston head engaging the inner wall of the barrel are resilient, there is permitted some play so that the piston rod 32 can move laterally slightly. With this arrangement, the ball will self-center when moving downwardly onto the seat 35. A compression spring 36 disposed between the stop means 30 and the piston 31 biases the piston and piston rod and thus the ball 34 downwardly against the seat 35 with a predetermined force indicated by the arrow F1 in FIG. 2.

Because of the communication of the piston and ball with the interior of the production tube 10 by way of the stem 27, the top of the ball 34 and the underside of the piston 31 are both subject to hydraulic pressure resulting from the hydraulic head of any fluid in the production tube 10. In FIG. 2 it will be noted that the cross sectional area of the valve seat 35 is indicated at A1 whereas the available cross sectional area of the underside of the piston 31 is indicated at A2. A2 is purposely made larger than A1. It can thus be seen that if F2 represents the hydraulic force exerted on the ball 34 by any hydraulic pressure in the production tube 10 and F3 represents the hydraulic force on the underside of the piston from this same pressure, the ball 34 can only be lifted from the seat 35 if the differential pressure between F2 and F3 is greater than the spring pressure F1; that is, this differential pressure must exceed the spring pressure to lift the ball. Once the ball 34 is lifted from the seat 35, flow of fluid as indicated by the dashed lines past the ball and through the seat results in a drop of the hydraulic pressure acting on the ball; that is, the force F2 and as a result, the ball will open up completely and provide for a smooth flow, this action being in the form of a snap or toggle type movement. The O-rings on the piston 31 prevent any of the fluid from passing upwardly into the spring barrel so that there is still a force exerted on the bottom of the piston holding the ball off of the seat against the pressure of the spring although this hydraulic force F3 has been decreased somewhat because of flow of hydraulic fluid through the valve.

Referring now once again to the upper portion of the valve structure of FIG. 2, the stop means 30 in the preferred embodiment disclosed includes an additional piston 37 sealing the upper end of the spring barrel 17 from communication with the annulus. A threaded member 38 is received in the upper end of the spring barrel and bears against the piston so that the positions of the stop means can be adjusted to change the predetermined compression force of the spring holding the ball on the valve seat.

Once an appropriate adjustment of the threaded member 38 has been made, an appropriate set screw 39 may be provided to lock the additional piston 37 in place as shown in FIG. 2.

The provision of the additional piston with appropriate O-rings provides for a sealed volume between the first mentioned piston 31 and the additional piston incorporating the compression spring 36. By providing a side plug 40 in the spring barrel 17 shown in FIG. 2, an appropriate transmission oil lubricant can be introduced into this closed volume and the plug 40 replaced. Only about 50 cc of such fluid is necessary and is indicated at 41. This fluid will serve to lubricate the O-rings for the first mentioned piston 31 in its up and down movement.

The structure of FIG. 2 is completed by the provision of one further improvement in the lower end of the valve seat housing 20. More specifically, the lower end 22 is provided with an orifice 42 defining the lower end opening and of reduced diameter. By providing this orifice 42, the flow of dewaxing fluid through the valve is slowed somewhat to thereby provide a desired degree of control and maintain sufficient back pressure to act on the first mentioned piston 31 and hold the ball 34 away from the seat during the dewaxing operation.

OPERATION

With all the foregoing in mind, the operation will be evident. Initially, the dewaxing valve itself may be manufactured as a complete unit without any reference to the tubing string in an oil well, the laterally extending stem portion 26 being simply welded into the periphery of a side opening in one of the production tubes. This particular production tube is then disposed in the pipe string at a level in the oil well above which wax would be expected to solidify onto the production tubing and below which the temperature is sufficient that no such solidification will take place.

The tubing string can then be lowered into the well and normal pumping operations carried out by operation of the sucker rods within the tubing string.

When wax builds up to the point that the proper flow of oil out the upper end of the tubing string is impeded, the overflow pipe to oil storage tanks is closed off and there is introduced into the production tubing from the surface a hot dewaxing fluid which itself may simply constitute extremely hot oil. This fluid is forced down the production tubing under high pressure, this pressure being sufficient to provide a differential pressure acting on the piston 31 in the valve as described in FIG. 2 sufficient to overcome the predetermined force applied by the spring 36 against the piston and ball 34. As described heretofore, this hydraulic head will also be acting on the ball but because the area A2 is greater than the area A1 there exists the referred to differential force which will reach a point sufficient to unseat the ball 34. At this point, the force applied on the ball 34 through hydraulic action is drastically reduced because of the flow of the fluid through the seat and even though there is a similar reduction of pressure acting on the piston 31, there still is sufficient force on the piston 31 because no leakage can take place around the piston to hold the ball upwardly. In fact, once contact is broken with the valve seat, the ball will simply snap upwardly in a toggle-like manner provided sufficient pressure is maintained on the dewaxing fluid.

There is thus an unimpeded flow of fluid which is carefully controlled by the size of the orifice 42 as described heretofore. This flow takes place down the production tubing, the hot dewaxing fluid melting wax W formed on the sides of the production tubing and carrying the melted wax through the dewaxing valve into the well annulus.

Once dewaxing has been completed, the reduction in the pressure of the fluid forced down through the production line will result in the spring 36 reseating the valve 34.

The source of hot oil is then disconnected from the production tubing and the tubing reconnected at the surface to fill appropriate storage tanks and pumping can be resumed.

From all of the foregoing, it can thus be appreciated that the present invention has provided a greatly improved dewaxing valve which can readily be connected into any production tubing string to facilitate dewaxing operations.

I claim:

1. A dewaxing valve for use with a production tube in a production tubing string in an oil well casing wherein sucker rods extend through the interior of the production tubing string for operating a down hole pump to bring oil in the lower portion of the well annulus defined between the casing and production tubing up through the production tubing to the well surface, said dewaxing valve including, in combination:

(a) a valve seat housing having a lower opening communicating with said annulus and an upper opening for communication with the interior of said production tube;

(b) a valve seat in said housing between said lower and upper openings, said valve seat facing said upper opening;

(c) a ball seated on said valve seat between said valve seat and upper opening so as to be on the upstream side of any fluid flow from the interior of said production tube through said valve to said annulus and, (d) means in said valve responsive to a fluid pressure in said production tube exceeding a predetermined value to lift said ball from said seat, whereby hot dewaxing fluid can be forced down said production tubing string at a pressure exceeding said predetermined pressure to open said valve and pass the dewaxing fluid to the well annulus.

2. A dewaxing valve according to claim 1, in which said means responsive to a fluid pressure comprises a hydraulic piston of greater cross sectional area than said valve seat connected to said ball, and a compression spring holding said ball onto said seat, said predetermined value being equal to the force of said compression spring less the differential hydraulic force acting on said piston.

3. A dewaxing valve according to claim 2, including means in said valve for adjusting said force of said compression spring.

4. A dewaxing valve for use with a production tube in a production tubing string in an oil well casing wherein sucker rods extend through the interior of the production tubing string for operating a down hole pump to bring oil in the lower portion of the well annulus defined between the casing and production tubing up through the production tubing to the well surface, said dewaxing valve including, in combination:

(a) a spring barrel having upper and lower ends and of a diameter to fit within said oil well annulus in adjacent parallel relationship to said production tubing;

(b) a valve seat housing having upper and lower ends positioned in axial alignment with said spring barrel;

(c) a T-collar having upper and lower arms with open ends for connection in coaxial alignment to said lower end of said spring barrel and said upper end of said valve seat housing, respectively, and having a laterally extending stem with a lateral opening connecting with the interior of said spring barrel and valve seat housing;

(d) a stop means in the upper end of said spring barrel;

(e) a piston in a lower portion of said spring barrel having a piston rod extending from said piston out said lower end of said spring barrel into said T-collar, said piston rod terminating in a ball;

(f) a valve seat in said valve seat housing facing upwardly and receiving said ball in seating relationship to close off communication between said lateral opening in said T-collar and said lower end opening of said valve seat housing, the cross sectional area of said valve seat being less than the cross sectional area of said piston;

(g) a compression spring in said spring barrel between said stop means and said piston urging said piston and said piston rod downwardly to hold said ball on said valve seat with a given predetermined force whereby, a side hole can be made in said production tube and said stem on said T-collar welded to the periphery of said hole so as to place said lateral opening into communication with the interior of said production tube, and support the spring barrel and valve seat housing on the side of the production tube, said production tube being then located in said production tubing string at a level in said oil well below that level at which wax begins to solidify onto said production tubing inhibiting oil flow through said tubing, so that hot dewaxing fluid, when forced down through said production tubing string can escape into said annulus by passing through said lateral opening and past said ball and valve seat, and out the lower end of said valve seat housing, the pressure build-up of said fluid being such that the differential force on said piston and ball from said pressure is sufficient to overcome said predetermined force exerted by said compression spring to effect an initial lifting of said ball from said seat, said ball then snapping upwardly in a toggle-like manner to completely open position after said initial lifting because of the loss of hydraulic force tending to hold the balls eated on said seat so that uninterrupted flow of said hot fluid may take place to remove the built-up wax in said production tubing string.

5. A dewaxing valve according to claim 4, in which said stop means includes an additional piston sealing the upper end of said spring barrel from communication with the annulus and a threaded member received in said upper end and bearing against said additional piston so that the position of said stop means can be adjusted to change said predetermined compression force holding said ball on said valve seat whereby adjustments can be made for proper operation of said dewaxing valve when the level of the valve in the production tubing string varies from well to well and thus the hydraulic force of the oil in the production string acting on the ball varies.

6. A dewaxing valve according to claim 5, in which there is provided a lubricating fluid between said first mentioned and additional pistons in said spring barrel for lubricating movement of said first mentioned piston.

7. A dewaxing valve according to claim 6, in which said lower end of said valve seat housing has a peripheral portion defining a reduced diameter orifice communicating with said annulus to thereby aid in controlling the flow of the dewaxing fluid through the valve.

* * * * *